US008684104B1

(12) United States Patent
Fisk, III et al.

(10) Patent No.: US 8,684,104 B1
(45) Date of Patent: Apr. 1, 2014

(54) DETACHABLE PIPE RAMMING HEAD WITH EFFICIENT LUBRICATION DISPERSAL

(76) Inventors: Andrew J. Fisk, III, Forest Hill, LA (US); Mark J. Case, Gasport, NY (US)

( * ) Notice: Subject to any disclaimer, the term of this patent is extended or adjusted under 35 U.S.C. 154(b) by 1258 days.

(21) Appl. No.: 12/082,354

(22) Filed: Apr. 10, 2008

Related U.S. Application Data

(60) Provisional application No. 60/923,493, filed on Apr. 13, 2007.

(51) Int. Cl.
*E21B 4/00* (2006.01)

(52) U.S. Cl.
USPC ..... 173/131; 173/90; 173/128

(58) Field of Classification Search
USPC ..... 173/1, 90, 128, 131; 405/184, 184.3, 405/174
See application file for complete search history.

(56) References Cited

U.S. PATENT DOCUMENTS

| | | | | | |
|---|---|---|---|---|---|
| 4,091,630 | A | * | 5/1978 | Nemoto et al. | 405/184 |
| 4,116,011 | A | | 9/1978 | Girault | |
| 4,380,842 | A | * | 4/1983 | Thomas | 15/304 |
| 4,449,853 | A | * | 5/1984 | Mennella et al. | 405/184 |
| 4,650,374 | A | | 3/1987 | Schmidt | |
| 4,671,703 | A | * | 6/1987 | Schmidt | 405/184 |
| 4,699,225 | A | * | 10/1987 | Bardoliwalla | 175/72 |
| 4,858,703 | A | * | 8/1989 | Kinnan | 175/19 |
| 4,990,028 | A | * | 2/1991 | Alexander et al. | 405/184 |
| 5,069,426 | A | * | 12/1991 | Gabrysch | 254/29 R |
| 5,104,263 | A | * | 4/1992 | Shibahara et al. | 405/184 |
| 5,110,237 | A | * | 5/1992 | Hesse | 405/184 |
| 5,174,393 | A | * | 12/1992 | Roberts et al. | 175/297 |
| 5,238,072 | A | | 8/1993 | Hesse | |
| 5,240,352 | A | * | 8/1993 | Ilomaki | 405/184 |
| 5,282,696 | A | * | 2/1994 | Solomon et al. | 405/184 |
| 5,505,558 | A | | 4/1996 | Brown | |
| 5,547,230 | A | * | 8/1996 | Bank et al. | 285/110 |
| 5,632,575 | A | | 5/1997 | Lorenzen et al. | |
| 5,758,730 | A | | 6/1998 | Derwand | |
| 5,984,583 | A | * | 11/1999 | Craigmile et al. | 405/184 |
| 6,039,505 | A | | 3/2000 | Tenbusch, II | |

(Continued)

FOREIGN PATENT DOCUMENTS

| | | |
|---|---|---|
| DE | 3736458 | 5/1989 |
| DE | 3905648 | 8/1990 |
| JP | 1192992 | 8/1989 |

(Continued)

OTHER PUBLICATIONS

TT Technologies, Inc., Grundoram Pneumatic Pipe Rammer, Grundoram Operators & Parts Manual, Mar. 2002, pp. 18-19.

*Primary Examiner* — Hemant M Desai
*Assistant Examiner* — Gloria R Weeks
(74) *Attorney, Agent, or Firm* — Simpson & Simpson, PLLC

(57) ABSTRACT

A detachable head for ramming a pipe casing including an external ring having a first diameter, wherein the first diameter is operatively sized to enable the external ring to engage with an outer surface of the pipe casing, a reaction ring having a second diameter, wherein the second diameter is smaller than the first diameter, and operatively sized to enable the reaction ring to engage with a front surface of the pipe casing, an internal ring having a third diameter, wherein the third diameter is smaller than both the first and second diameters, and operatively sized to enable the external ring to engage with an inner surface of the pipe casing, and wherein the reaction ring is secured between the internal and external rings.

15 Claims, 6 Drawing Sheets

(56) References Cited

U.S. PATENT DOCUMENTS

| | | | | |
|---|---|---|---|---|
| 6,443,658 | B1 | 9/2002 | Lincoln | |
| 6,626,248 | B1 * | 9/2003 | Roberts et al. | 175/5 |
| 6,874,540 | B2 * | 4/2005 | Lee | 138/31 |
| 2006/0180312 | A1 * | 8/2006 | Bracksieck et al. | 166/312 |
| 2008/0124178 | A1 * | 5/2008 | Rohde et al. | 405/184.5 |
| 2008/0193220 | A1 * | 8/2008 | Crane | 405/184 |

FOREIGN PATENT DOCUMENTS

| | | |
|---|---|---|
| JP | 1207595 | 8/1989 |
| WO | 90/15197 | 12/1990 |
| WO | 95/21984 | 8/1995 |

* cited by examiner

DETACHABLE PIPE RAMMING HEAD WITH EFFICIENT LUBRICATION DISPERSAL

CROSS-REFERENCE TO RELATED APPLICATIONS

This application claims the benefit under 35 U.S.C. §119 (e) of U.S. Provisional Application No. 60/923,493 filed on Apr. 13, 2007, which application is incorporated herein by reference.

FIELD OF THE INVENTION

The present invention generally relates to horizontal pipe ramming, and more specifically to a detachable head for horizontal pipe ramming which efficiently disperses lubrication.

BACKGROUND OF THE INVENTION

Pipe ramming is a method known in the art which is used to install steel casing pipe for various underground utilities including water, sewer, electric, communications and natural gas facilities. The primary advantage of pipe ramming is that it does not require a trench to be cut in the ground the entire length of the pipe casing being laid. Thus, pipe ramming is commonly utilized to install pipe underneath surface impediments such as highways, railroads, rivers or other structures that prohibit standard excavation and other "cut and cover" pipe laying techniques.

In order to install casing via pipe ramming, a launching and a receiving pit must be excavated on either side of the surface impediment that would prohibit standard excavation and pipe laying techniques. Typically, a pneumatic piston, or ram, is affixed to the back edge of the casing and seated in heavy steel collar that engages with and inside the casing. The ram drives the casing horizontally, or substantially horizontally, forward when the air supply to the ram is actuated.

The leading edge of the casing must be reinforced to withstand the impact as it advances horizontally through the ground. It is also critical to ensure that the outer diameter of the leading edge is slightly larger than the outer diameter of the pipe casing in order to reduce friction as the pipe casing progresses through the soil. A larger outer diameter is traditionally accomplished by welding an external steel ring to the casing. It is equally important that the inner diameter of the leading edge is slightly smaller than the inner diameter of the casing to decrease internal friction of the soil that compacts inside the pipe casing. A smaller inner diameter is accomplished by welding an internal ring to the casing. The installation of these rings in traditional pipe ramming is labor intensive and therefore very costly. The leading edge and inner and outer rings may be referred to as the ramming or thumper head.

A lubricant or cutting/drilling fluid, typically a bentonite slurry, is injected into the annular space created between the outside of the pipe and the soil, as the pipe is being driven. The lubricant is pumped to an external manifold that diverts the slurry through a small opening into the casing and through ports that deliver the slurry to the casing exterior. The manifold is welded to the casing proximate to the leading edge, supplied through a small diameter steel pipe, typically ½" or ¾", which is also welded to the casing exterior.

The most efficient way to remove the compacted soil plug from the casing is to "pig" it. Pigging typically involves inserting one or two foamed polystyrene cylinders (the "pigs") into the pipe casing, and then pneumatically propelling the cylinders through the pipe via a manifold. This ejects the soil plug out of the casing and into an open pit. In a conventional pipe ramming process the head of the pipe casing which includes the leading edge and the outer and inner rings must be cut off before pigging so that the pigs can pass by the internal ring without incurring damage. The casings are frequently difficult to pig because the lubricant is not dispersed uniformly around the internal soil plug, if at all.

After a traditional ramming head is fabricated and used once, it is commonly reused by cutting a short section of about 4'-5' from the main body of the casing. This short section, including the ramming head, can then be re-welded to a new pipe casing to once again perform the aforementioned function. However, both the initial fabrication and subsequent cutting and welding of the thumper head, is expensive and labor intensive. For example, the welding of a typical 30" diameter ramming head can take as much as an hour and a half for a two person team to complete.

Thus, what is needed is an easily detachable and reusable ramming head to reduce the cost and increase the speed and efficiency of pipe ramming operations. Furthermore, what is needed is a pipe-ramming head which enables an efficient dispersal and distribution of lubrication for faster and more efficient installation and pigging processes.

BRIEF SUMMARY OF THE INVENTION

The present invention broadly comprises a detachable head for ramming a pipe casing including an external ring having a first diameter, wherein the first diameter is operatively sized to enable the external ring to engage with an outer surface of the pipe casing, a reaction ring having a second diameter, wherein the second diameter is smaller than the first diameter, and operatively sized to enable the reaction ring to engage against a front surface of the pipe casing, an internal ring having a third diameter, wherein the third diameter is smaller than both the first and second diameters, and operatively sized to enable the internal ring to engage with an inner surface of the pipe casing, and wherein the reaction ring is secured between the internal and external rings.

In one embodiment, the detachable head further includes a lubrication manifold in the external ring operatively arranged to provide the detachable head and the pipe casing with lubricant, wherein the lubricant flows in a first channel between the external ring and the reaction ring, and wherein the first channel terminates proximate to the outer surface of the pipe casing. In a further embodiment, the lubricant is typically a bentonite slurry. In yet a further embodiment, the reaction ring includes at least one aperture for enabling the lubricant to flow in a second channel located between the reaction ring and the external ring, and wherein the second channel terminates proximate to the inner surface of the pipe casing.

In another embodiment, the detachable head includes a plurality of spacers secured to the external ring for reducing friction between the external ring and the pipe casing. In a further embodiment, the ramming head includes a lubrication manifold in the external ring operatively arranged to provide the detachable head and the pipe casing with lubricant, wherein the lubricant flows in a first channel defined by the spacers between the external ring and the reaction ring, and wherein the first channel terminates proximate to the outer surface of the pipe casing. In yet another embodiment, the internal ring includes a plurality of spacers for reducing friction between the internal ring and the pipe casing. In a further embodiment, the ramming head includes a lubrication manifold in the external ring operatively arranged to provide the detachable head and the pipe casing with lubricant, wherein the lubricant flows in a second channel defined by the spacers between the internal and reaction rings, and wherein the second channel terminates proximate to the inner surface of the pipe casing.

In another embodiment, the internal, external, and reaction rings are aligned to form a leading edge for cutting through soil. In a further embodiment, the leading edge is substantially formed by welding the internal, external, and reaction rings together.

The present invention also comprises a method of pipe ramming comprising the steps of: (a) placing a detachable pipe ramming head over a first end of a pipe casing; (b) securing a ram to a second end of the pipe casing, opposite the first end; and, (c) actuating the ram to drive the detachable ramming head and the pipe casing through a portion of earth or soil. In a further embodiment, the method includes step (d) supplying the pipe casing and detachable ramming head with a lubricant via a lubrication manifold in the detachable head for more efficient pipe ramming.

It is a general object of the present invention to provide a detachable ramming head for pipe ramming operations that does not need to be re-welded before each pipe ramming operation.

It is another object of the present invention to provide a ramming head which enables the efficient dispersal and distribution of lubrication for a faster pipe ramming operation.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
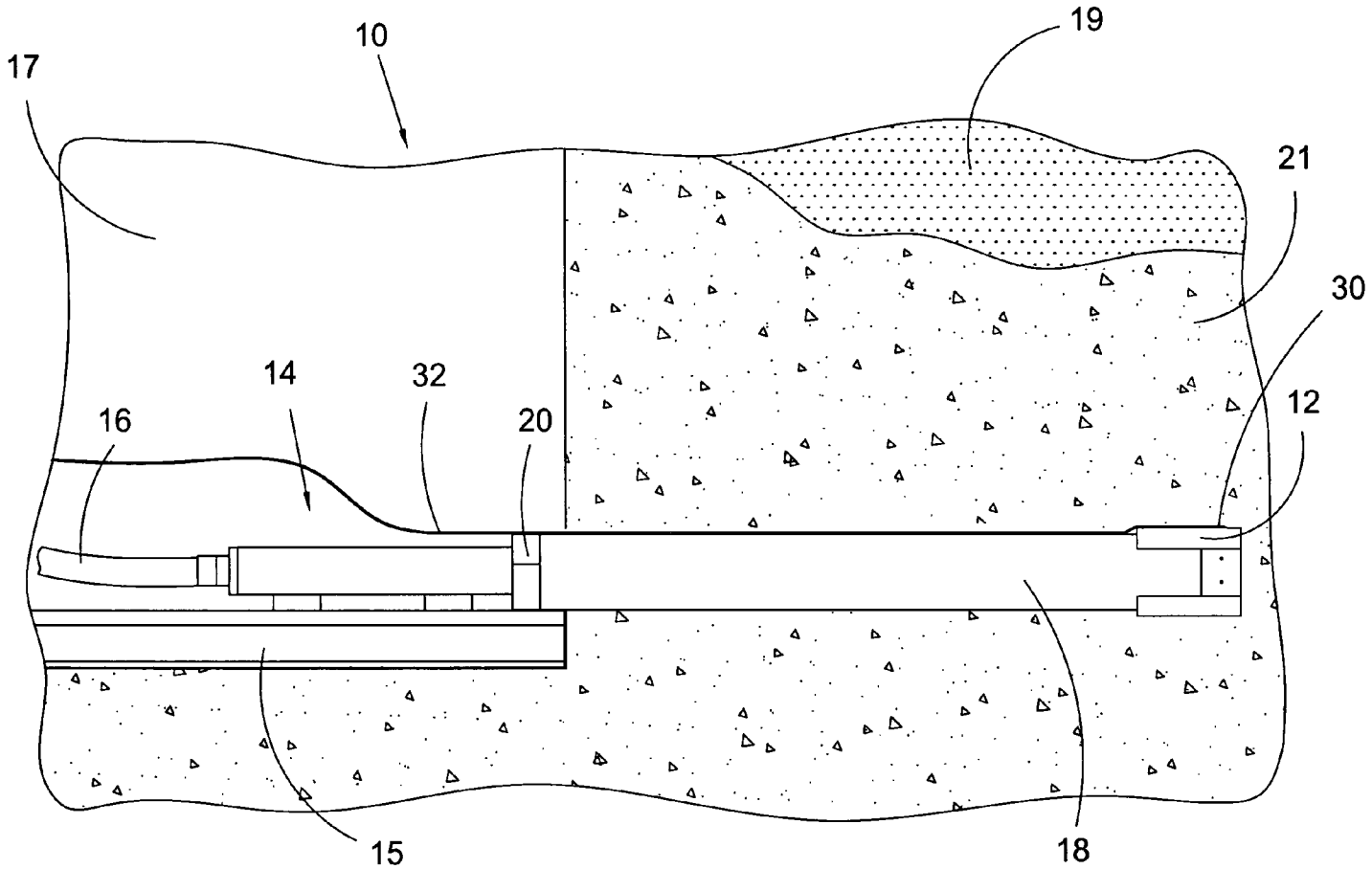
FIG. 1 is a side view of a pneumatic ram driving a pipe casing and current invention detachable ramming head horizontally through soil.

A typical application of the current invention detachable ramming head is shown in FIG. 1. Shown generally is ramming assembly 10 which includes detachable ramming head 12 installed on pipe casing 18, both of which are being driven by ram 14. Ram 14 can be any pneumatic ram, or the like, suitable for driving pipe horizontally through the earth. Supply line 16 supplies ram 14 with the pressurized air necessary to power the ram. Supply line 16 is shown cut off, but it should be understood that in actual use the supply line would be connected to a pressurized air tank (not shown). Collar 20 is preferably included to provide a secure engagement between ram 14 and pipe casing 18. In a preferred embodiment, ram 14 and pipe casing 18 are guided by rails, or beams 15, which ensure the pipe casing enters earth, or soil, 21 at the desired angle. Typically, pipes are installed horizontally, but sometimes it is advantageous to install pipe casings at an angle slightly above or below horizontal. As shown in FIG. 1, the pipe casing and detachable ramming head are almost entirely rammed into the earth.

Lubrication manifold 30 on detachable ramming head 12 enables lubrication, such as a bentonite slurry, to be injected proximate to the ramming head to facilitate the ramming process. Similar to supply line 16, it should be understood that lubrication line 32 supplies lubrication from a tank or reservoir (not shown).

It can also be seen in FIG. 1 that ram 14 and a portion of pipe 18 are in trench 17. Trench 17 is cut into earth, or soil, 21 specifically to act as a staging area to drive pipe 18 through the earth. Advantageously, as mentioned supra, horizontal pipe ramming enables pipe to be driven under obstacles, such as obstruction 19, without having to remove the obstruction. Obstruction 19 could be a body of water such as a river or creek, a foundation of a building, a road, a large boulder, or the like. Traditional pipe laying would require a trench to be cut into the earth along the entire length of the pipe, which would necessitate the removal or avoidance of obstruction 19. It should be understood that in addition to the staging trench 17 there would be an second trench on the opposite side of the obstruction.

Figure 2A:
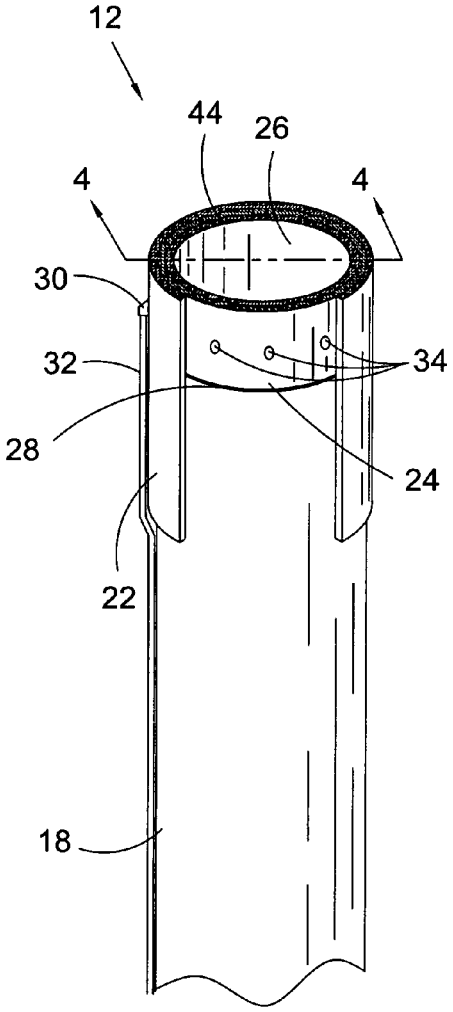
FIG. 2A is a perspective view of the current invention detachable ramming head installed on one end of a pipe casing.
Figure 2B:
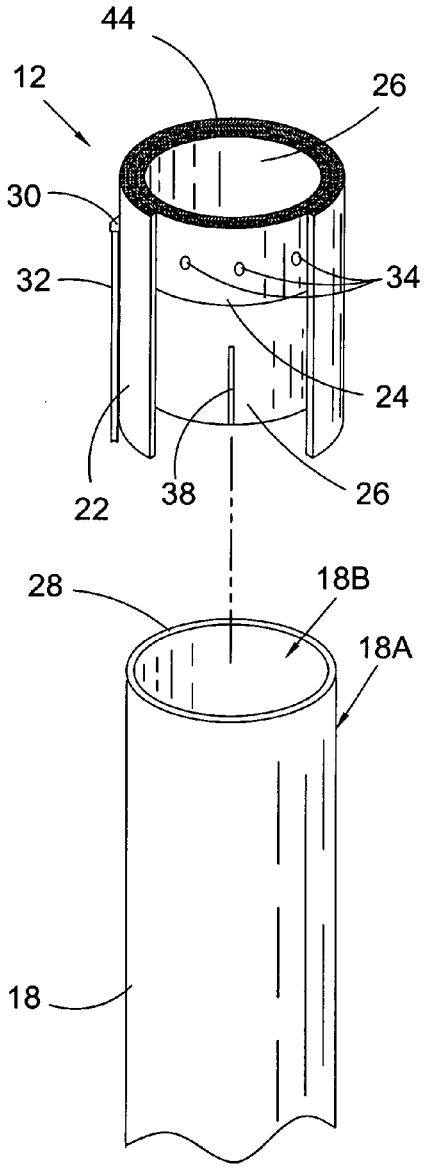
FIG. 2B is a perspective view of the ramming head of FIG. 2A detached from the pipe casing.

FIGS. 2A and 2B show pipe casing 18 with ramming head 12 installed and detached, respectively. It can be seen that ramming head 12 generally includes external ring 22, reaction ring 24, and internal ring 26. It can be seen that pipe casing 18 engages between external ring 22 and internal ring 26 with front face 28 of the pipe casing engaging flush against reaction ring 24. That is, outer surface 18A of pipe casing 18 engages with the external ring, inner surface 18B engages with the internal ring, and front surface 28 engages against the reaction ring. In a preferred embodiment, leading edge 44, located on detachable ramming head 12 opposite from pipe casing 18, is comprised of external ring 22, reaction ring 24, and internal ring 26 welded together.

In a preferred embodiment, lubrication manifold 30 is included on external ring 22 to supply lubrication, such as bentonite, via line 32 into ramming head 12. In a preferred embodiment, reaction ring 24 includes apertures 34, which enable the lubrication supplied by lubrication manifold 30 to disperse more effectively throughout the ramming head, as will be described in more detail infra. Although manifold 30 is only shown injecting lubricant at one location, the manifold may branch out around the perimeter of the external ring and inject lubrication into a plurality of locations about the external ring. Also, only three apertures 34 are shown, but it should be appreciated that the apertures are present about the entire circumference of the reaction ring. Also in a preferred embodiment, internal ring 26 includes spacer bars 38 for reducing the friction between inner surface 18B of pipe casing 18 and the internal ring.

From FIGS. 2A and 2B it can be seen that surface 28 on pipe casing 18 engages against reaction ring 24. In a typical operation, pipe ramming is relatively slow, as each blow from ram 14 only drives the pipe casing a fraction of an inch through the earth. Since ramming head 12 is not physically connected or attached to pipe casing 18, the pipe casing and ramming head act result in a hammer-and-nail effect. That is, the ram drives the pipe casing forward into the detachable ramming head, which launches forward and cuts into the earth like a projectile, independent from the pipe casing. The welded leading edge 44 is used to cut through the earth as the pipe is rammed. The hammer-and-nail type effect can result in deeper cuts for each ram actuation, and therefore a faster and more efficient ramming process. As discussed previously, traditional pipe ramming heads are physically welded to the pipe casings, and therefore do not experience the same hammer-and-nail effect, resulting in slower installations.

Figure 3:
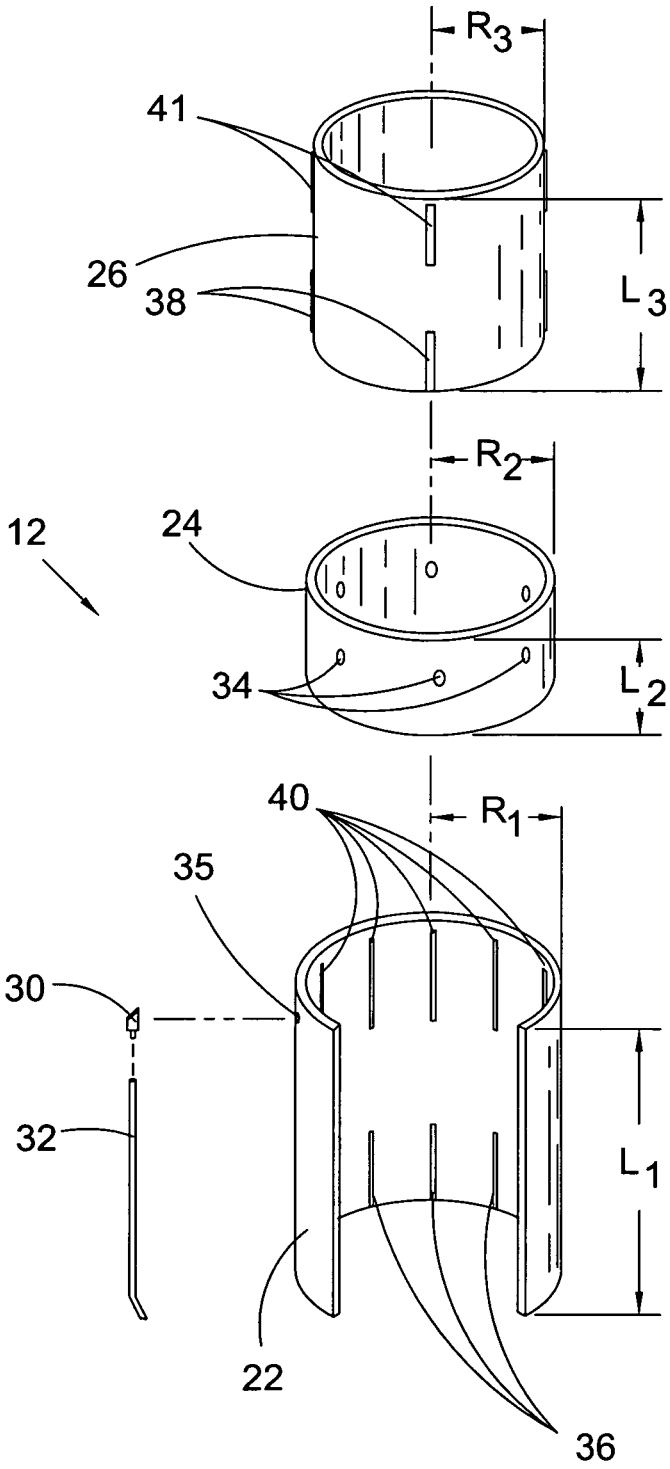
FIG. 3 is a perspective exploded view of the current invention detachable ramming head.

An exploded view of detachable ramming head 12 is shown in FIG. 3. It can again be seen that ramming head 12 includes external ring 22, reaction ring 24, and internal ring 26. In a preferred embodiment, the internal ring also includes spacer bars 41 which are included to create channel 39 between the reaction ring and the internal ring (shown in FIG. 4). Similar to spacer bars 38 and 41 on internal ring 26, external ring 22 includes spacer bars 36 and 40. Spacer bars 36 are similar to spacer bars 38, in that they are included to reduce frictional forces between the ramming head and the pipe casing. Spacer bars 40, however, are similar to spacer bars 41, and are included to create a channel 37 between reaction ring 24 and external ring 22 so that the lubrication provided by lubrication manifold 30 can be dispersed more thoroughly and effectively throughout ramming head 12 (shown in FIG. 4).

It can be seen from FIG. 3 that each ring is generally a hollow cylinder having a length, diameter, and wall thickness. As shown, the external ring, reaction ring, and internal ring have radii R1, R2, and R3, and lengths L1, L2, and L3 respectively. It should be understood that each ring has an inner and outer radius, and the radii discussed herein are used for illustrating the general proportions of the rings with respect to each other, and therefore do not necessarily have to be any one radius, but the radii should be measured consistently for each ring. Radius R1 is larger than radius R2, which in turn is larger than radius R3. Clearly, since a diameter is twice that of a radius, the diameter of the external ring is the largest, while the diameter of the internal ring is the smallest, with the diameter of the reaction ring sized between the two. Radius R2 is substantially equal to the radius of pipe casing 18 so surface 28 on the pipe casing can engage with and against the reaction ring. Additionally, radius R1 is sized with respect to pipe casing 18 so that external ring 22, or spacer bars 36 on the external ring, substantially engage with and against outer surface 18A of the pipe casing. Likewise, radius R3 is sized with respect to pipe casing 18 so that internal ring 26, or spacer bars 38 on the internal ring, substantially engage with and against inner surface 18B of the pipe casing.

It can also be seen that length L1 is greater than length L3, which in turn is greater than length L2. In a preferred embodiment, the ratio of L1:L3:L2 is approximately 3:2:1. With these ratios, a portion of pipe casing 18 engages with the internal and external rings so that the pipe casing is generally located between the rings. By generally located, we mean that at least a portion of the pipe casing is directly between portions of the internal and external rings. It should be clear that the amount of pipe casing 18 that can be inserted between the internal and external rings is limited by reaction ring 24. As discussed supra, surface 28 on the pipe casing contacts the reaction ring when ram 14 is activated. During ramming, the pipe casing stays aligned with and follows detachable ramming head 12, because the pipe casing remains generally located between the internal and external rings. In this way, the pipe casing will follow the detachable ramming head as it progresses through the earth without the need to physically connect or affix the pipe casing to the ramming head.

The wall thicknesses of the rings or pipe casing are not germane to the invention and can be any suitable wall thicknesses known in the art. A preferred thickness for a typical application is approximately half of an inch, but other thicknesses may also work, as is known in the art.

Figure 4:
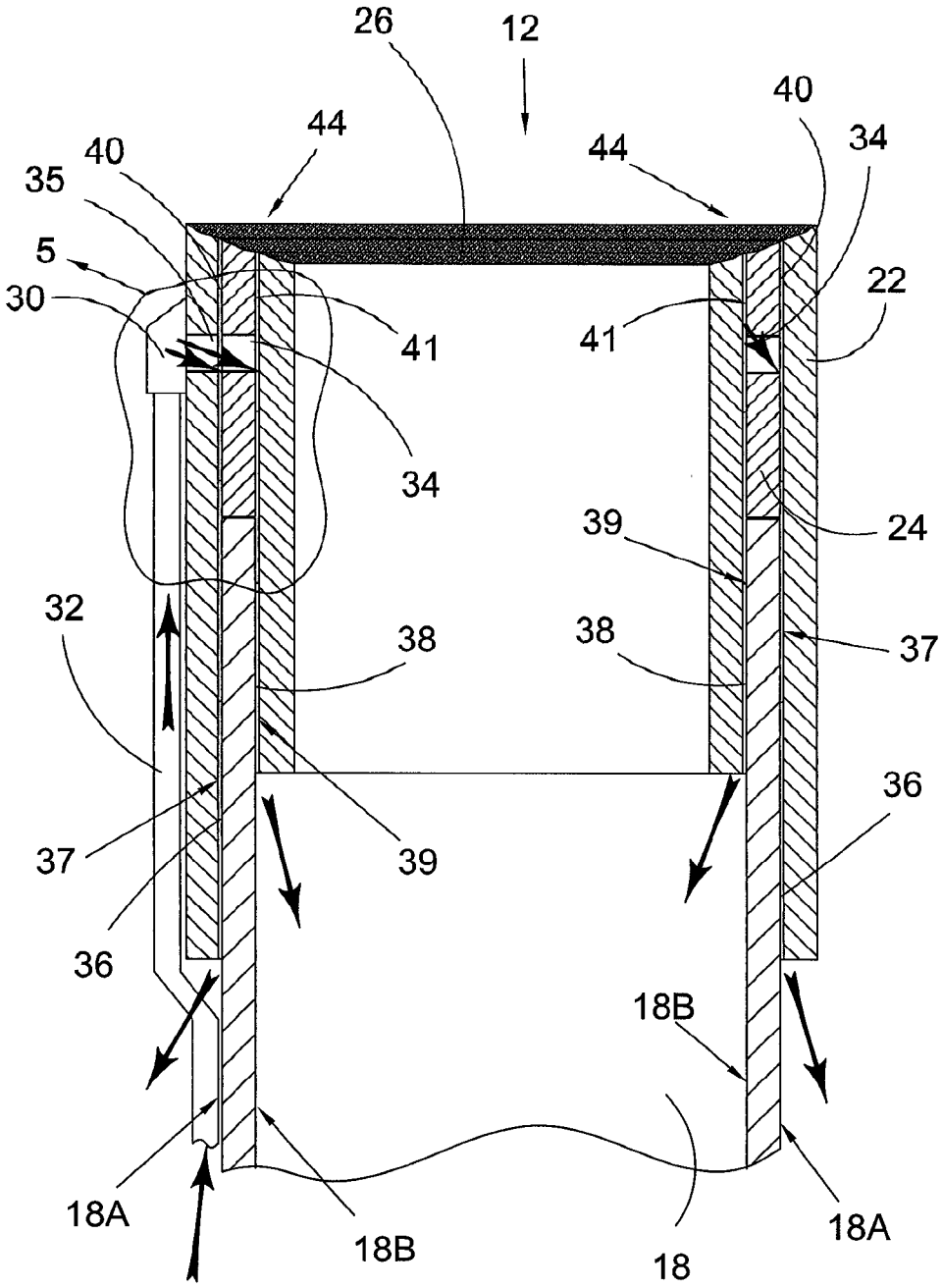
FIG. 4 is a cross-sectional view of the ramming head taken generally along line 4-4 in FIG. 2A; and, FIG. 5 is an enlarged view of the area circled in FIG. 4 detailing the flow of lubricant supplied by a lubrication manifold throughout the detachable ramming head; and, FIGS. 6 and 7 are perspective views illustrating one method of fabricating an internal ring of the current invention pipe ramming head.

FIG. 4 shows a cross-sectional view of ramming head 12 installed on pipe casing 18, illustrating how the pipe casing is generally located between external ring 22 and internal ring 26. Bolded arrows are included on FIG. 4 to illustrate the directional flow of lubrication throughout the ramming head. It can be seen that lubrication is supplied by lubrication manifold 30, and flows through aperture 35 in external ring 22. After flowing through aperture 35, some lubrication flows around spacer bars 40 into channel 37 between external ring 22 and reaction ring 24. The rest of the lubrication flows through apertures 34 in reaction ring 24, around spacer bars 41, and down gap 39 between reaction ring 24 and internal ring 26. Thus, it can be seen that the flow in channel 37 emerges proximate to outer surface 18A of pipe casing 18. This lubrication is used to reduce friction between the pipe casing and the soil and therefore facilitate the driving of the pipe casing through the soil. The rest of the flow emerges from channel 39 proximate to inner surface 18B of pipe casing 18. This lubrication reduces the friction between inner surface 18B of the pipe casing any soil which collects and compacts inside the pipe casing as the pipe casing is rammed through the earth. Similar to above, this enables the pipe to be rammed more effectively, and also enables the pipe casing to be more efficiently "pigged" or purged of the soil once the ramming is complete.

It can also be seen that in a preferred embodiment, leading edge 44 is generally comprised of the three rings secured together by welds. The leading edge is preferably sloped slightly inwards to more effectively cut through soil. Additionally, this helps funnel and compact soil into the open ramming head and down the pipe casing more effectively.

Figure 5:
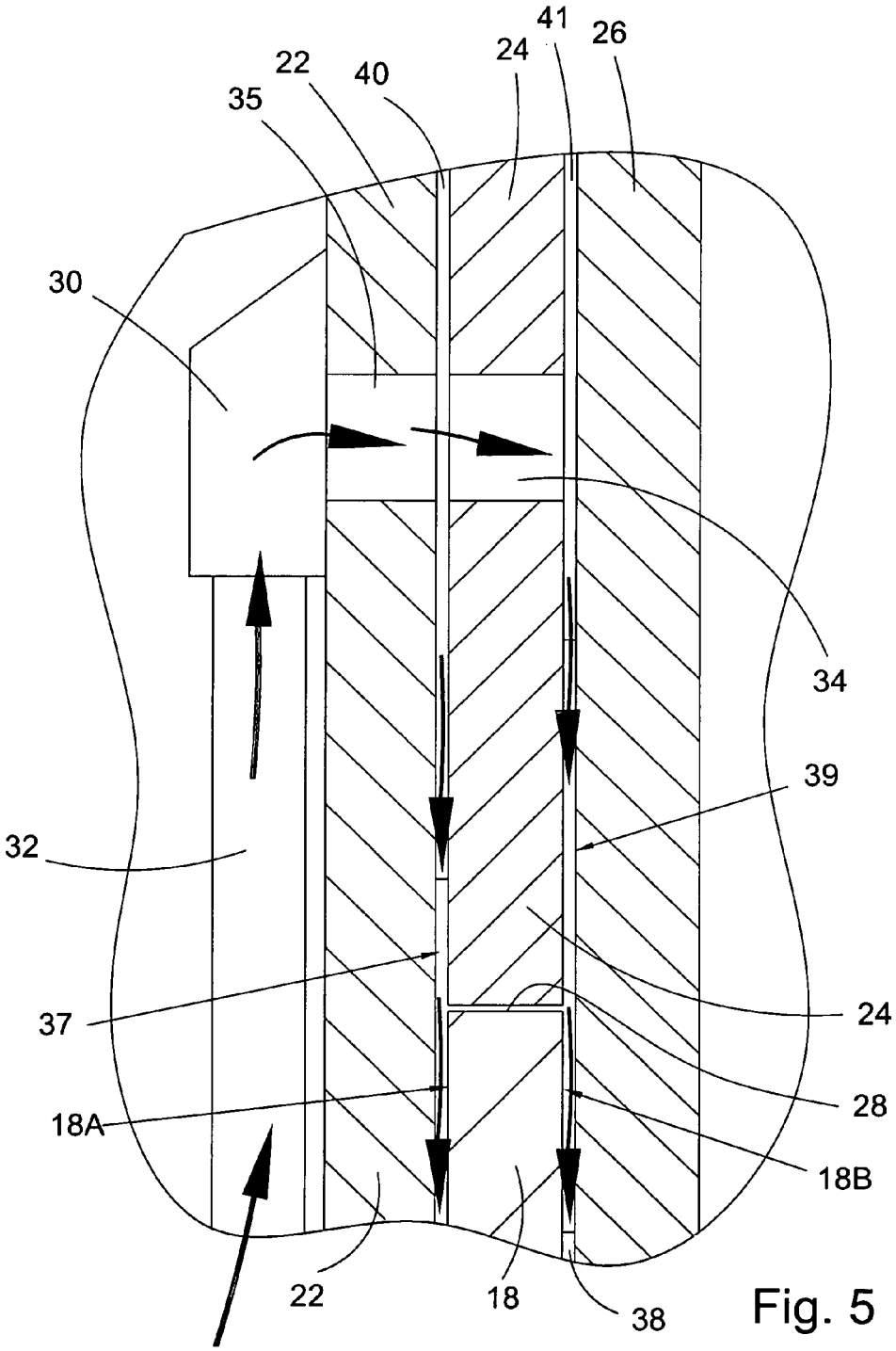

An enlarged view of the cross-section shown in FIG. 4 is shown in FIG. 5. In this view it can more readily be appreciated how the lubrication flows from line 32 to manifold 30, through apertures 34 and 35, and down gaps 37 and 39. The flow of lubrication is indicated by the large, bold directional arrows. It can be seen that the flow arrives at lubrication manifold 30 via lubrication line 32. From lubrication manifold 30, the flow enters aperture 35 in external to ring 22. Once through aperture 35, some lubrication flows down channel 37, while some of the lubrication continues through aperture 34 and flows down channel 39.

Figure 6:
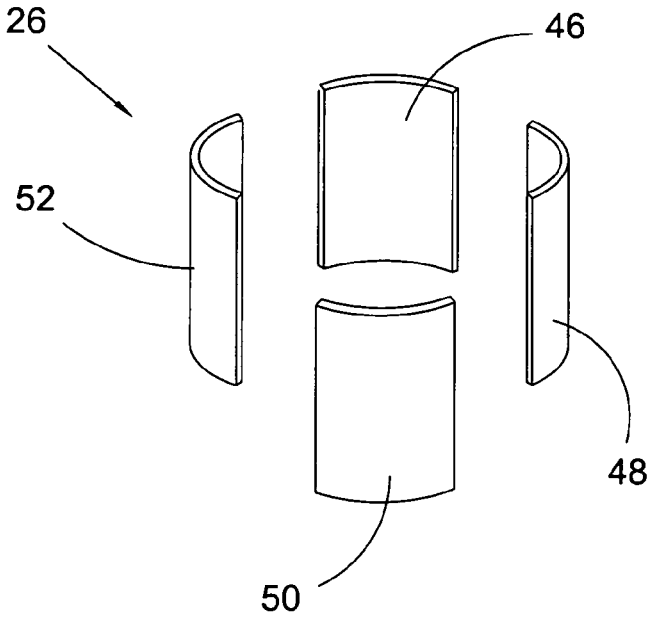
Figure 7:
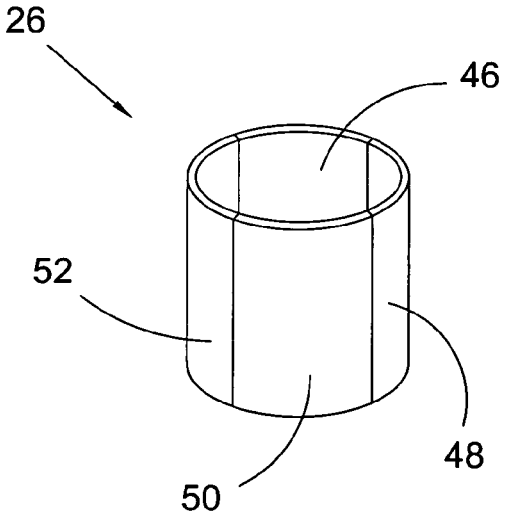

FIGS. 6 and 7 show one method of fabricating internal ring 26 for detachable ramming head 12, which is particularly useful if the detachable ramming head must be fabricated out in the field, and not pre-fabricated in a workshop. FIG. 6 illustrates internal ring 26 cut into quadrants 46, 48, 50, and 52, then secured back together in FIG. 7. In a preferred embodiment, the quadrants are re-attached by welding. Advantageously, one can cut away enough material while making the quadrants to effectively reduce the diameter of the resulting ring. That is, by removing material with each cut it is possible to create rings with smaller diameters. Therefore, one could take a section of pipe equal in diameter to pipe casing 18 (or likewise cut a piece off of an end of pipe casing 18) and use the technique shown in FIGS. 6 and 7 to re-create a ring with a diameter that is smaller than the original diameter. In this way, an internal ring 26 can be fabricated from a section of pipe which originally had a larger diameter. It should be understood that internal pipe 26 may be simply created from a section of pipe having the appropriately sized diameter, but since various sizes of pipe are not always available out in the field, such a technique as illustrated in FIGS. 6 and 7 may be required.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A detachable head for providing a cutting edge during a ramming operation of a pipe casing comprising:

an external ring having a first diameter, wherein said first diameter is operatively sized to enable said external ring to engage with an outer surface of said pipe casing;

a reaction ring having a second diameter, wherein said second diameter is smaller than said first diameter, and operatively sized to enable said reaction ring to engage flushingly against a front surface of said pipe casing;

an internal ring having a third diameter, wherein said third diameter is smaller than both said first and second diameters, and operatively sized to enable said internal ring to engage with an inner surface of said pipe casing; and, wherein said reaction ring is secured between said internal and external rings, and wherein said detachable head is not fastened to said pipe casing and forms said cutting edge for guiding said pipe casing during said ramming operation of said pipe casing.

2. The detachable head recited in claim 1 further including a lubrication manifold in said external ring operatively arranged to provide said detachable head and said pipe casing with lubricant, wherein said lubricant flows in a first channel between said external ring and said reaction ring, and wherein said first channel opens onto to said outer surface of said pipe casing.

3. The detachable head recited in claim 2 wherein said lubricant is a bentonite slurry.

4. The detachable head recited in claim 2 wherein said reaction ring includes at least one aperture through said reaction ring for enabling said lubricant to flow in a second channel located between said reaction ring and said internal ring, and wherein said second channel opens onto said inner surface of said pipe casing.

5. The detachable head recited in claim 1, wherein said external rings includes a first plurality of spacer bars secured to said external ring for reducing friction between said external ring and said pipe casing, said first plurality of spacer bars forming at least one first channel wherein one end of said at least one first channel opens onto said outer surface of said pipe casing.

6. The detachable head recited in claim 5 further including a lubrication manifold in said external ring operatively arranged to provide said detachable head and said pipe casing with lubricant, wherein said lubricant flows in said at least one first channel and wherein said lubricant flows onto said outer surface of said pipe casing.

7. The detachable head recited in claim 1 wherein said internal ring includes a second plurality of spacer bars for reducing friction between said internal ring and said pipe casing said second plurality of spacer bars forming at least one second channel wherein one end of said at least one second channel opens onto said inner surface of said pipe casing.

8. The detachable head recited in claim 7 further including a lubrication manifold in said external ring operatively arranged to provide said detachable head and said pipe casing with lubricant, wherein said lubricant flows in said at least one second channel and wherein said lubricant flows onto said inner surface of said pipe casing.

9. The detachable head recited in claim 1 wherein said internal, external, and reaction rings are welded together to form a leading edge for cutting through soil.

10. A detachable head for providing a cutting edge during a ramming operation of a pipe casing comprising:

an external ring having a first diameter and a first set of spacer bars secured thereto, wherein said first set of spacer bars on said external ring to form at least one first channel wherein one end of said at least one channel terminates onto an outer surface of said pipe casing;

a reaction ring having a second diameter and a plurality of apertures through said reaction ring, wherein said second diameter is smaller than said first diameter and operatively sized to enable said reaction ring to engage flushingly against a front surface of said pipe casing;

an internal ring having a third diameter and a second set of spacer bars, said second set of spacer bars forming at least one second channel, wherein said third diameter is smaller than both said first and second diameters, and operatively sized to enable one end of said second set of spacer bars on said internal ring to terminate onto an inner surface of said pipe casing;

a lubrication manifold secured to said external ring for supplying a lubricant into said detachable ramming head; and, wherein said reaction ring is secured between said internal and external rings and wherein said lubricant flows through said apertures in said reaction ring and down said first and second at least one channels for distributing said lubricant throughout said detachable ramming head and onto said outer and inner surfaces of said pipe casing, and wherein said detachable head is not fastened to said pipe casing and forms said cutting edge for guiding said pipe casing during said ramming operation of said pipe casing.

11. A pipe casing assembly comprising:

a pipe casing; and, a detachable head for providing a cutting edge during a ramming operation of said pipe casing, said detachable head including:

an external ring having a first diameter, wherein said first diameter is operatively sized to enable said external ring to engage with an outer surface of said pipe casing;

a reaction ring having a second diameter, wherein said second diameter is smaller than said first diameter, and operatively sized to enable said reaction ring to engage flushingly against a front surface of said pipe casing;

an internal ring having a third diameter, wherein said third diameter is smaller than both said first and second diameters, and operatively sized to enable said internal ring to engage with an inner surface of said pipe casing;

wherein said reaction ring is secured between said internal and external rings; and, wherein said detachable head is not fastened to said pipe casing and forms said cutting edge for guiding said pipe casing during said ramming operation of said pipe casing.

12. The pipe casing assembly recited in claim 11 further including a lubrication manifold in said external ring operatively arranged to provide said unfastened detachable head and said pipe casing with lubricant, wherein said lubricant flows in a first channel between said external ring and said reaction ring, and wherein one end of said first channel opens onto said outer surface of said pipe casing.

13. The unfastened detachable head recited in claim 12 wherein said internal, external, and reaction rings are welded together to form a leading edge for cutting through soil.

14. The pipe casing assembly recited in claim 11, wherein said external ring includes a plurality of spacer bars secured to said external ring for reducing friction between said external ring and said pipe casing, said spacer bars extending along at least part of the length of said external ring to form at least one channel and wherein one end of said at least one channel opens on said outer surface of said pipe casing.

15. The pipe casing assembly recited in claim 14 further including a lubrication manifold in said external ring operatively arranged to provide said unfastened detachable head and said pipe casing with lubricant, wherein said lubricant flows at least one aperture through said external ring into said at least one channel and wherein said lubricant flows through said at least one channel onto said outer surface of said pipe casing.

* * * * *